US005785443A

United States Patent [19]

Rubin

[11] Patent Number: 5,785,443

[45] Date of Patent: Jul. 28, 1998

[54] ERGONOMIC SNAP-FIT CARTRIDGE PEN

[75] Inventor: Burton S. Rubin, New York, N.Y.

[73] Assignee: Evo Pen Inc., New York, N.Y.

[21] Appl. No.: 49,408

[22] Filed: Apr. 20, 1993

[51] Int. Cl.[6] ..... B43K 23/00

[52] U.S. Cl. ..... 401/6; 401/88; 81/439; 30/337

[58] Field of Search ..... 81/438, 439, 436, 81/177.85, 489; 401/6, 92, 93, 88, 98; 7/165, 167; 279/24, 76, 79; 30/337, 339

[56] References Cited

U.S. PATENT DOCUMENTS

| | | | |
|---|---|---|---|
| D. 43,242 | 11/1912 | Bernstein | 401/6 X |
| D. 292,104 | 9/1987 | Keller, Jr. . | |
| D. 292,297 | 10/1987 | Bingham | 401/6 X |
| 654,722 | 7/1900 | Francis | 401/93 |
| 814,020 | 3/1906 | Clifford | 81/439 X |
| 825,985 | 7/1906 | Schwertenberg | 401/6 |
| 1,021,316 | 3/1912 | Johnson et al. | 279/24 |
| 1,188,394 | 6/1916 | Bernstein | 401/225 |
| 1,497,363 | 6/1924 | Doppel | 81/438 |
| 1,743,505 | 1/1930 | Turgeon | 81/438 X |
| 1,936,213 | 11/1933 | Snedden | 401/93 |
| 2,318,171 | 5/1943 | Lipic, Jr. | 401/98 |
| 2,621,688 | 12/1952 | Wales | 81/436 |
| 2,788,817 | 4/1957 | Leniz | 81/438 X |
| 3,246,930 | 4/1966 | Krekeler | 279/79 X |
| 3,994,605 | 11/1976 | McKnight | 401/6 X |
| 4,037,975 | 7/1977 | Huffman | 401/6 |

FOREIGN PATENT DOCUMENTS

| | | | |
|---|---|---|---|
| 133947 | 12/1951 | Sweden | 81/439 |
| 9562 | of 1895 | United Kingdom | 401/6 |

*Primary Examiner*—Steven A. Bratlie

*Attorney, Agent, or Firm*—Merchant, Gould, Smith, Edell, Welter & Schmidt, P.A.

[57] ABSTRACT

A hand-held implement, is provided with a body including an elongated snap-fit post and an elongated snap-fit cartridge housing. The snap-fit cartridge housing includes a coaxial recessed groove and readily snap-fits into the body of the pen by the resilient engagement of the tip of the snap-fit post into the coaxial recessed groove of the snap-fit cartridge housing. The cartridge housing can be readily removed from the body of the pen and replaced with another cartridge housing inserted in its place. The body of the implement has external surfaces which define contours which match and ergonomically engage the surfaces of a user's thumb and fingers when the user grasps the implement, so as to provide a large surface area of contact between the user's hand and the implement. The increased area of contact between the user's hand and the implement, compared to traditional designs, decreases the required level of applied unit area pressure, and also provides for greater control consequently facilitating manipulation of the implement. The exterior of the implement is sufficiently small so that, while in use, the body of the implement does not extend outside or beyond the hand of the user. Such a hand-held implement may advantageously be used in all manually performed activities utilizing hand-held instruments, including for example, writing, painting, cutting, soldering, digitalizing and applying cosmetics.

21 Claims, 8 Drawing Sheets

ERGONOMIC SNAP-FIT CARTRIDGE PEN

FIELD OF THE INVENTION

The present invention is directed to an implement with a readily removable snap-fit cartridge housing which is held in one's hand and used in manual activities. Examples of such implements include writing implements such a pens and pencils, cutting implements such as knives, awls and scribes, and other hand-held implements such as brushes, cosmetics applicators, soldering devices and computer styluses.

BACKGROUND OF THE INVENTION

In the past, traditional hand-held implements have generally been provided with a cylindrical shaft which is manipulated primarily by the thumb and index finger of the user acting in conjunction with each other to control the tip of the device so as to accomplish a specified task. The users of such traditional cylindrical shaft implements often utilize the middle finger in order to manipulate the implement. Additionally, the users of such traditional cylindrical shaft implements may often utilize the arch as a lever against the working thumb and index finger as a fulcrum, in order to manipulate the implement. Examples of traditional single tip hand-held implements are writing instruments such as pens and pencils, cutting instruments such as knives and awls, tools such as soldering devices and scribes, painting instruments such as brushes, cosmetics application equipment and digitalizing contacting devices such as computer styluses. During their use, the surface of such traditional implements contacts a relatively small surface area of the user's skin.

These traditional implements are generally configured so that in use the cylindrical shaft of the device extends along a direction between the thumb and index finger of the user and thence out away from the hand. This traditional orientation of manual implements can be considered to date back to a period of history when feather quills were used as writing implements. Thus, the elongated shape of the feather quill has tended to govern the basic design concept for the configuration of hand-held implements.

Most of the improvements to such traditional hand-held implements have concerned the working portions of the devices. For example, improvements in pens have primarily concerned new inks, ink flow mechanisms and delivery of the ink to the writing surface. Other developments regarding these traditional implements have related to aesthetics, or the ease with which such devices may be stored or transported. However, a fundamental disadvantage for these traditional implements is that they have only a single rigidly mounted working tip. The fundamental disadvantage for these traditional hand-held implements which are based upon the configuration of the feather quill is that the ubiquitous cylindrical shaft does not conform well to the surfaces of the user's fingers, palm or closed inner hand.

One of the less developed areas of hand-held implement design is the mounting of the tip in the body of the implement. One of the least developed areas of hand-held implement design is the interrelationship between the external shape of the implement and the natural shape of the user's hand. This interrelationship has a significant effect on the user's comfort and ability to control and manipulate the implement, particularly when the implement is to be used for a prolonged period of time. As previously stated, a fundamental disadvantage with hand-held implements whose external shape is based on a cylindrical shaft is that they do not conform to the contacted surfaces of the fingers which grasp the implement. Normally, such implements contact a relatively small proportion of the surface area of the user's fingers, leaving a large area of the thumb and fingers unused. Further, the direct physical contribution of the larger portions of the hand in using such hand-held implements is relatively small and the bulk of the user's hand is not used to dissipate the physical stress that accompanies the use of the hand-held implement. This situation eventually leads to discomfort for the user over a period of use, as the rigid surfaces of the implement exert pressure (in the form of negative leverage) and friction on the user's fingers. Thus, it is advantageous that a larger percentage of the surface area of the hand and fingers which work with a hand-held implement should contribute to controlling the hand-held implement.

Various attempts have been made to modify hand-held implements to reduce discomfort and fatigue. For example, implements have been produced which have soft rubber coating materials. However, such materials tend to reduce the control of the implement in the hand and easily become soiled. Also, it has been proposed to provide hand-held implements with different concave surfaces. However, these concave surfaces have not overcome the basic problems arising from the basic idea of a cylindrical shaft oriented to extend in a direction between the thumb and index finger of the user and out away from the hand.

SUMMARY OF THE INVENTION

The present invention is directed to providing an ergonomic hand-held implement with a snap-fit removable cartridge housing such that the cartridge housing can be readily removed and replaced without tools, unusual dexterity or any special skills.

Another object of the invention is to provide a ergonomic hand-held implement which can be held with a high degree of comfort for long periods of time with reduced fatigue of the hand.

Another object of the invention is to provide an ergonomic hand-held implement which allows for performing manual activity with a high degree of precision.

A further object of the present invention is to provide an ergonomic hand-held implement which provides less friction and pressure on the contacting surfaces of the hand, thereby reducing the development of blisters or calluses on the fingers or hand, for example, along the third finger which result from friction and pressure during extended use.

A still further object of the present invention is to provide an ergonomic hand-held implement of smaller dimensions, but which provides a greater proportion of it's surface in contact with the hand, thus enabling a greater degree of control and manipulation while simultaneously providing for greatly increased comfort.

The present invention accomplishes these and other objectives by providing a hand-held implement which has a snap-fit cartridge housing from which a working tool extends, for example, a pen or pencil point independent of the structural mounting requirements of the working tip. Thus, the implement can then be provided with an ergonomically shaped body, with the body preferably having a forward surface extending upwards from the bottom portion, and first and second side surfaces extending upward from the bottom surface and rearward from the front surface. The forward surface is adapted to be engaged by the index finger of the user, and the surfaces are oriented so that in use the implement extends in a direction which is no further toward the user's thumb than the user's index finger. The implement is of sufficient size so that the implement fits comfortably in the palm and does not extend outside the palm of the user, such that the instrument provides a greater conformation with the contours of the thumb, second and third fingers of the hand, and the closed palm, when the implement is in the position in which the device is used. In so doing, a relatively large contact area exists between the hand and the instrument. The increased area of contact decreases the pressure at any given point of contact, and the increased area of contact also allows for greater control of the instrument. The instrument of the present invention may be advantageously used in multiple manually performed activities utilizing hand-held instruments, including for example, writing, painting, cutting, soldering, surgery, and cosmetics application by simple replacement of the snap-fit cartridge housing.

Other objects, advantages and features of the present invention will be more readily appreciated and understood when considered in conjunction with the following detailed description as drawings.

BRIEF DESCRIPTION OF THE DRAWINGS

These and other aspects of the present invention will now be described with reference to the accompanying drawings, in which.

DETAILED DESCRIPTION OF THE INVENTION

Referring to the figures, it can be seen that the hand-held implement of the present invention is used to carry a working tip 10. In the illustrated embodiments, working tip 10 is a pen cartridge. However, the working tip can be any one of a variety of interchangeable devices which require precise manual control. Examples include other writing implements such as pencils and fountain pens, the blade for a cutting implement, a brush for painting, a brush or puff for cosmetic application, a soldering tip or a contacting device such as a computer stylus. The working tip is mounted in a snap-fit cartridge housing and extends from the bottom portion 12 of the implement.

Figure 2:
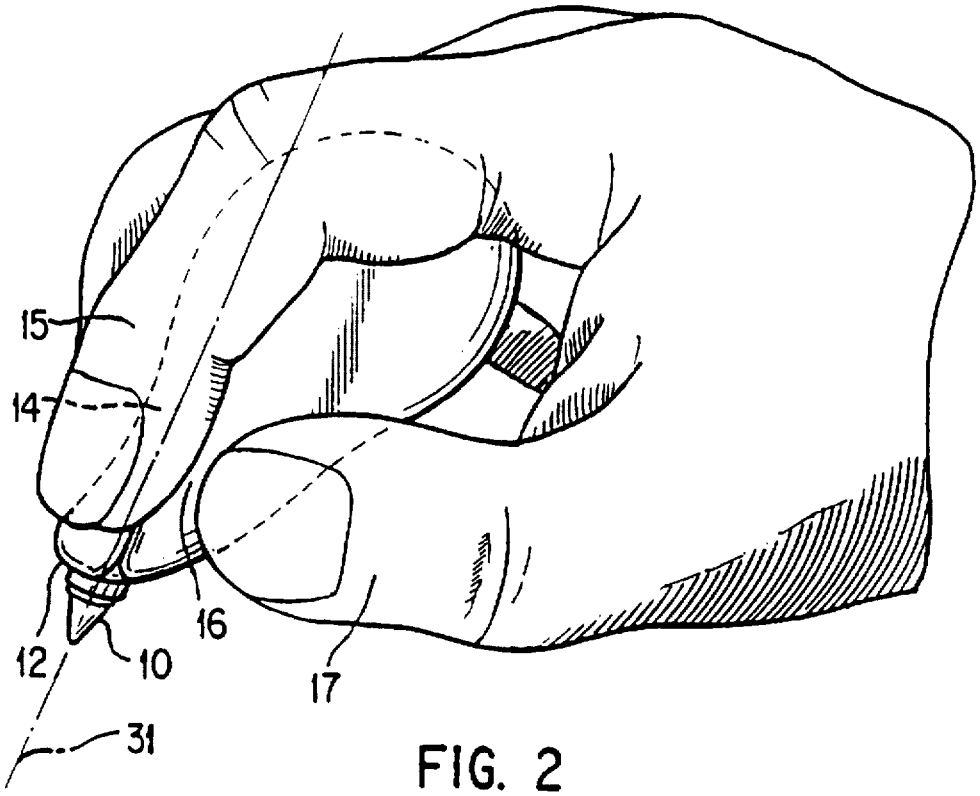
FIG. 2 illustrates a perspective view of a the hand-held implement according to the present invention as held in a hand.
Figure 1:
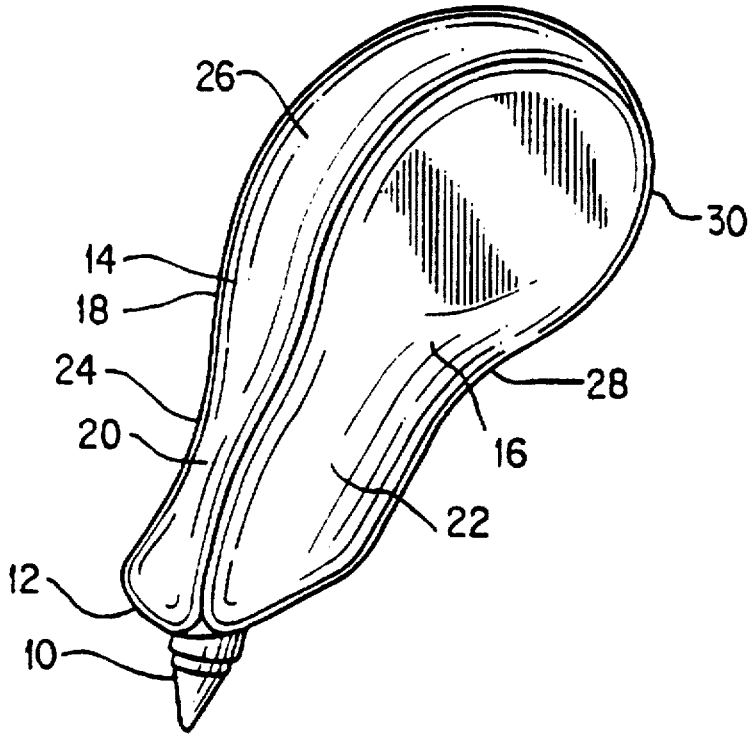
FIG. 1 illustrates a perspective view of a hand-held implement according to the present invention in a fully assembled state.
Figure 4:
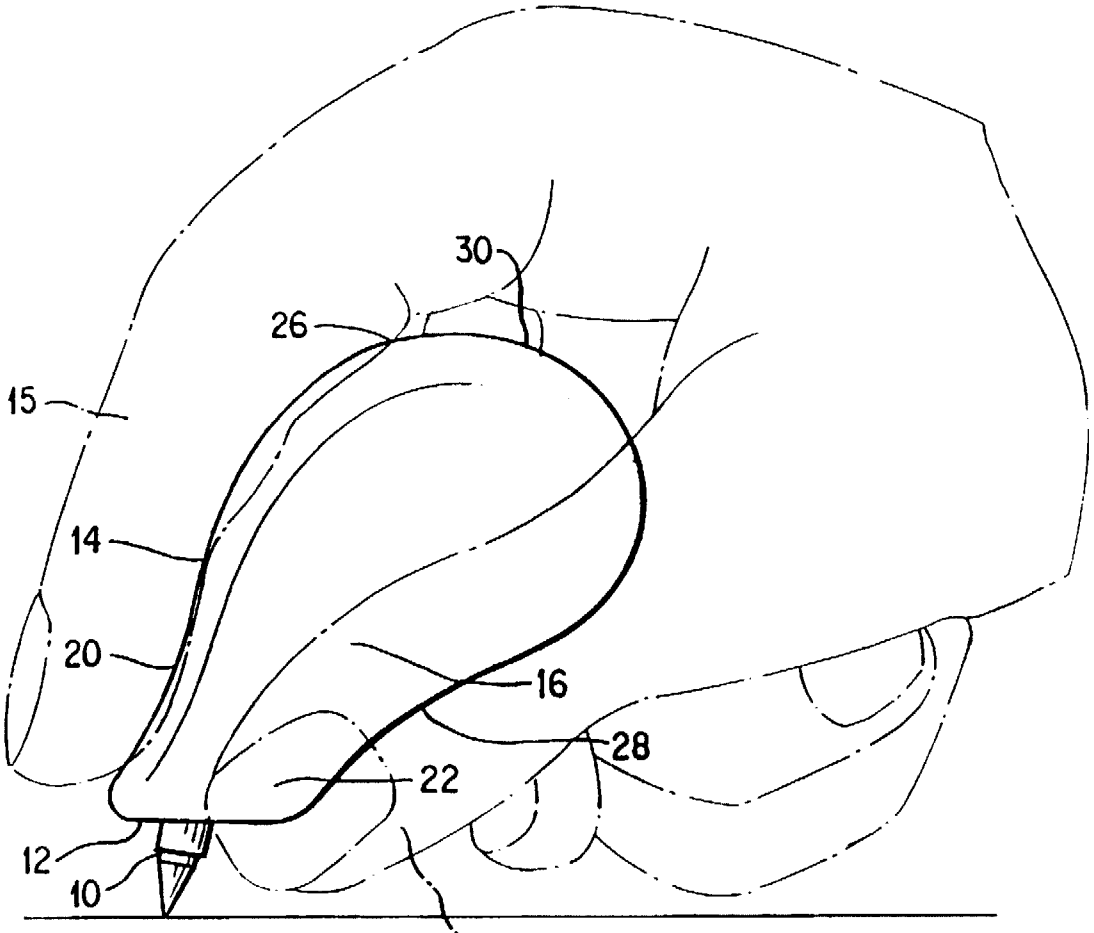
FIG. 4 illustrates a side view of the hand-held implement according to the present invention as held in a hand.
Figure 3:
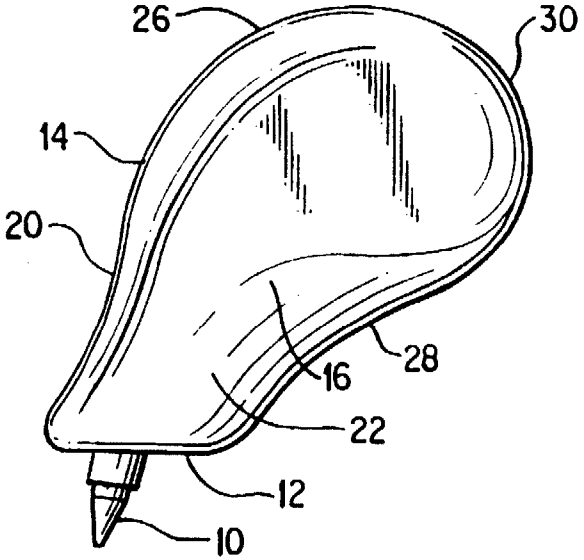
FIG. 3 illustrates a side view of the hand-held implement shown in FIG. 1.

In a preferred embodiment, extending upward from the bottom portion 12 is a forward surface 14 and first and second side surfaces 16 and 18, respectively. The side surfaces 16 and 18 extend rearward from the forward surface 14. As seen in FIGS. 2 and 4, in use, the forward surface is engaged by the index finger 15 of the user, the first side surface 16 is engaged by the thumb 17 of the user and the second side surface 18 is engaged by the third finger of the user.

In this preferred embodiment, the forward surface 14 is provided with a concave contour 20 adjacent the bottom portion 12. Similarly, the side surfaces 16, 20 and 18 are provided with concave contours 22 and 24 adjacent the bottom portion. The concave contours are smooth and gradual, without sharp edges. Similarly, the surfaces of the implement are joined smoothly, with rounded edges. These features enhance the level of comfort for the user of the implement.

In this preferred embodiment, the forward surface 14 also includes a convex contour 26 extending from the concave contour 20 to contour 30. Again, the two portions are joined smoothly.

This preferred embodiment of the implement is provided with a rearward surface 28. This surface is provided with a concave contour adjacent the bottom portion which is joined to the convex contour of the forward surface by the continuous convex contour 30. Again, contours 26, 28 and 30 are joined smoothly. The concave contour of the rearward surface 28 results in the implement having a reduced size in the area of the concave contours 20, 22 and 24. This permits the comfortable positioning of the third finger of the user during use, with the side of the third finger of the user engaging the concave contour 24 in the area of the end or middle joint of the finger. The convex contours 26 and 30 provide a somewhat bulbous upper portion which provides a feeling of security when the implement is held by the closed palm in the hand.

Figure 6:
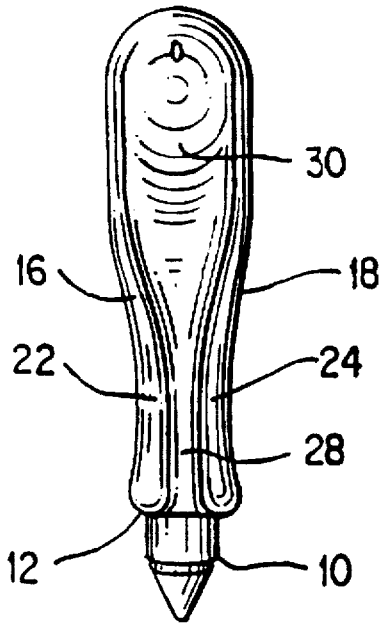
FIG. 6 illustrates a rear view of the hand-held implement according to the present invention as shown in FIG. 1.
Figure 5:
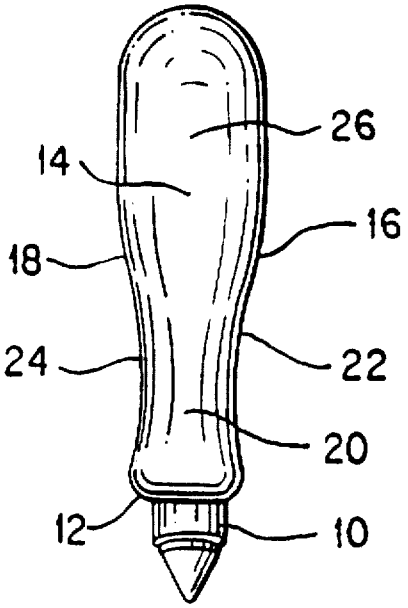
FIG. 5 illustrates the front view of the hand-held implement shown in FIG. 1.

Additionally, as seen particularly in FIG. 6, the width of this embodiment of the implement decreases in the direction of the rearward surface, particularly in the area of the concave contours 20, 22 and 24. This taper provides increased comfort and control.

In a particularly preferred embodiment, the width of the implement is thin enough so as to facilitate storage of the implement in a pocket of the user's clothing.

Referring again to FIGS. 2 and 4, it can be seen that, in use, the meaty pads of the index finger of the user 15 extends along the forward surface 14 of this preferred embodiment of the implement. Thus, the present invention in use permits the hand of the user to assume a comfortable arched configuration, with the implement being substantially co-planar with the arch defined by the index finger and corresponding portion of the surrounding closed palm of the user. This preferred embodiment of the implement is of a sufficiently small length that it does not extend beyond the hand of the user, but rather fits within the user's hand. The bulbous upper portion extends well into the interior of the palm, with the area of convex contour 30 contacting the palm, particularly between the base of the user's index finger and the base of the thumb. When the user's hand is curled to grasp the instrument, the flesh between the thumb and fingers forms around the implement quite readily and can comfortably accept the bulbous upper portion of the implement.

In this preferred embodiment, the surfaces 12, 14 and 16 are oriented so that the implement in use will extend in a direction which is preferably essentially parallel to the user's index finger, but in any event, a direction which is no further toward the thumb of the user than the index finger. Thus, instead of extending in the direction of the user's thumb or the space between the thumb and index finger, the index finger defines the limit on the direction in which the implement extends with respect to the thumb. This relationship can also be conceptualized by considering the tool 10 as defining a longitudinal axis, which is identified by numeral 31 in FIG. 2. The longitudinal axis 31 is preferably substantially parallel to the index finger of the user, but in any event is not oriented outside of the index finger in the direction of the thumb.

Figure 7:
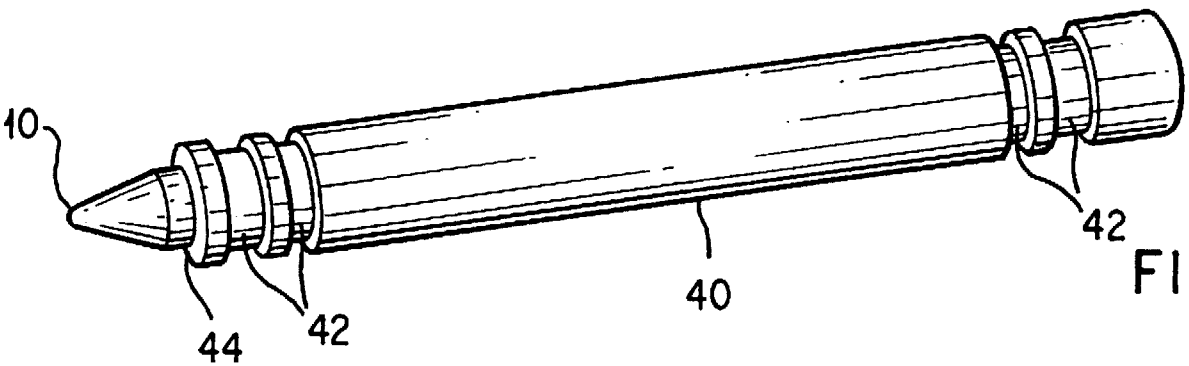
FIG. 7 illustrates a perspective view of a snap-fit cartridge housing according to the present invention.

Referring to FIG. 7, a snap-fit cartridge housing 40 according to the present invention is equipped with a working tip 10 and one or more coaxial recessed grooves 42. In a preferred embodiment, the cartridge housing 40 is cylindrical and elongated. However, the snap-fit cartridge can be any shape (including square, oblong, conical, etc.) and need not be elongated. A cartridge 44 extends from the snap-fit cartridge housing and contains the working tip 10.

Figure 8:
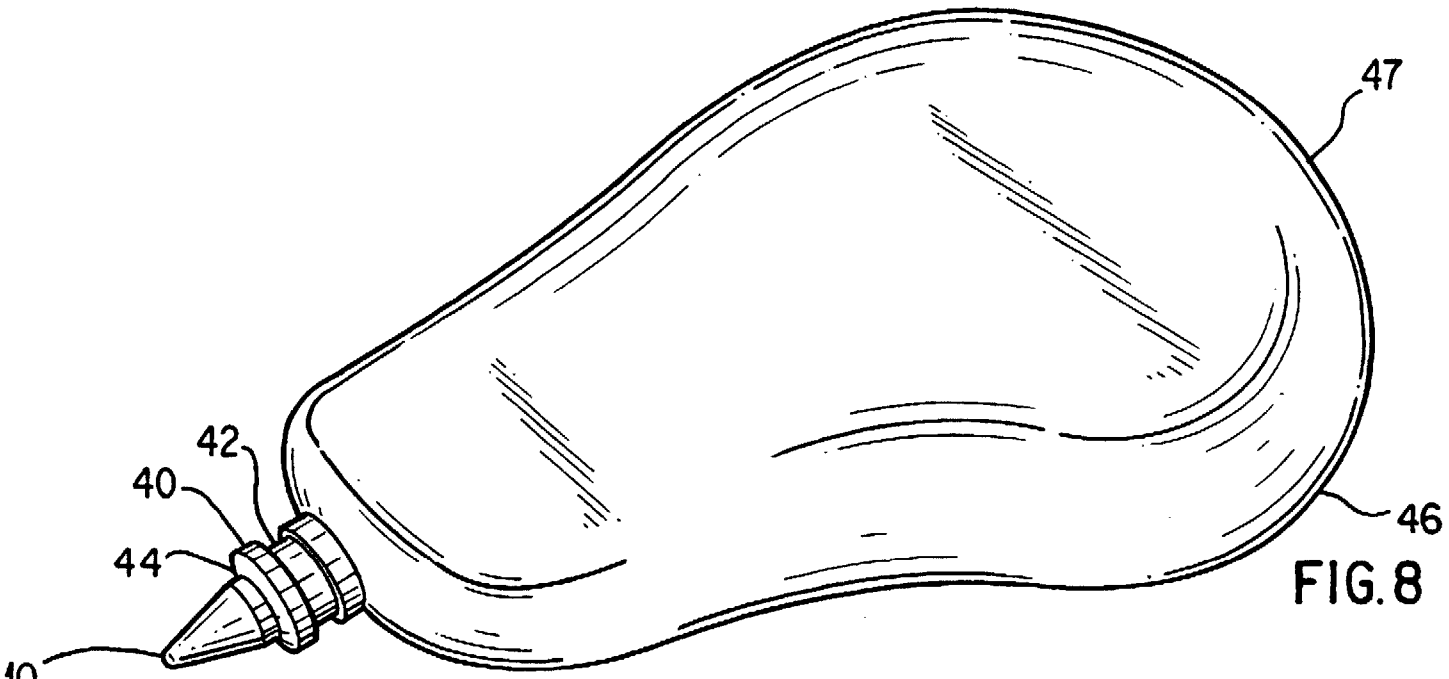
FIG. 8 illustrates a perspective view of a hand-held implement according to the present invention.

Referring to FIG. 8, a perspective view of a hand-held implement according to the present invention is shown. It can be seen that the external shape of the body does not correspond to the external shape of the snap-fit cartridge housing 40. Both the body and the snap-fit cartridge housing 40 may independently have any longitudinal shape. Also, both the body and the snap-fit cartridge housing 40 may independently have any cross-sectional shape. In a preferred embodiment, the external shape of the hand-held implement is non-cylindrical. In a more preferred embodiment, the cross sectional area encompassed by the body is significantly larger than the cross sectional area encompassed by the snap-fit cartridge housing and the shortest dimension of the body is longer than the shortest dimension of the snap-fit cartridge housing. The first body panel 46 and the second body panel 47 of the hand-held implement according to the present invention enclose the snap-fit cartridge housing 40. The snap-fit cartridge housing 40 may be located anywhere within the body and extend from any facet of the body. A working tip 10 extends from the snap-fit cartridge housing 40. In a preferred embodiment, the cartridge 44 is a pen cartridge.

Figure 9:
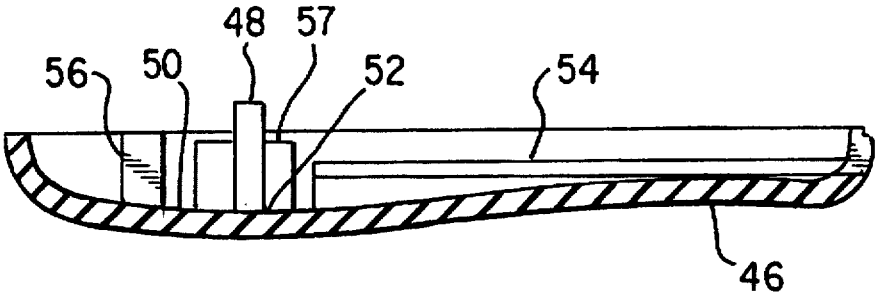
FIG. 9 illustrates a sectional view of the first body panel according to the present invention shown in FIG. 10.

Referring to FIG. 9, a first body panel 46 according to the present invention is equipped with an elongated snap-fit post 48 mounted on the inner surface 50 of the first body panel 46. In a preferred embodiment, the snap-fit post 48 has a polygonal cross section and the first body panel 46 is non-cylindrical. The snap-fit post may be of any cross sectional shape and be located anywhere within the body. In a preferred embodiment, a first end of the elongated snap-fit post 52 is formed on the inner surface 50 of the first body panel 46. The snap-fit post 48 can also be fabricated so as to touch or fit into the inner surface 51 of the second body panel 47 in FIG. 13. The first body panel 46 is preferably equipped with an engagement tab 57. Engagement tab 57 cause snap-fit post 48 to engage the recessed groove 42 of the snap-fit cartridge holder 40 with greater resilience. In a preferred embodiment, the shape of the first body panel 46 is curved and the first body panel 46 is also equipped with at least one longitudinal ridge 54. In a more preferred embodiment, the shape of the first body panel 46 is convexo-concave and the first body panel is also equipped with one or more abutment tabs 56 which limit the rearward movement of the snap-fit cartridge housing 40. Abutment tabs 56 preferably extend outward from the inner surface 50 of first body panel 46 to the center line of the assembled body of the hand-held implement.

Figure 10:
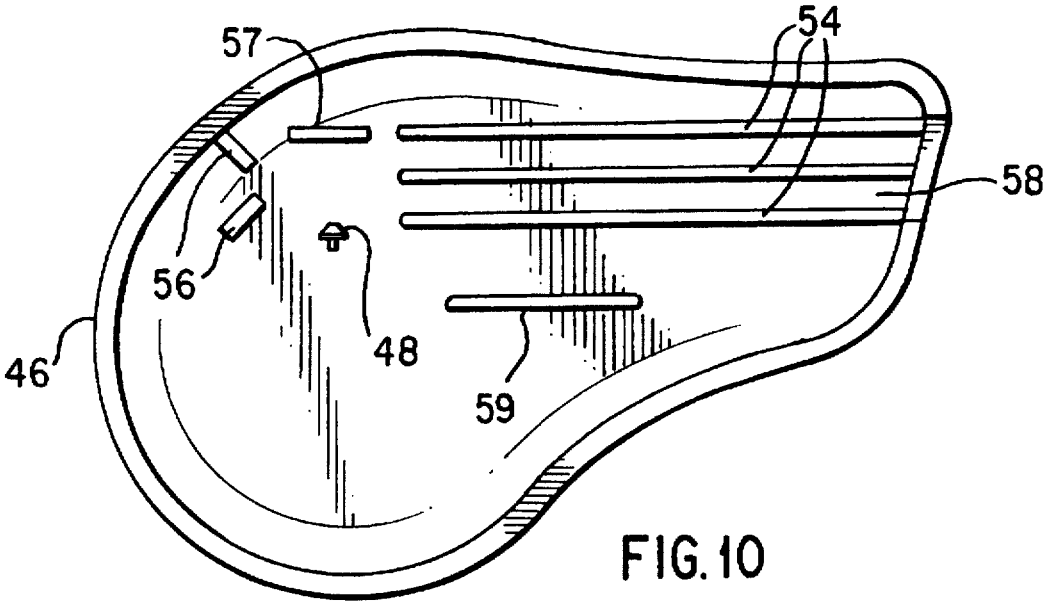
FIG. 10 illustrates a side view of a first body panel according to the present invention.

Referring to FIG. 10, a first body panel 46 according to the present invention is preferably equipped with three parallel ridges 54 which define a longitudinal snap-fit cartridge housing receptacle 58. In a preferred embodiment, the longitudinal snap-fit cartridge housing receptacle 58 is cylindrical. The first body panel 46 is preferably equipped with abutment tabs 56. The abutment tabs 56 are of a predetermined length which results in the tip 10 extending a desired distance from the bottom portion 12 of the hand-held implement. The snap-fit post 48 may be of any cross sectional geometry and size. A thicker snap-fit post 48 will engage the recessed grooves 42 of the snap-fit cartridge holder 40 with greater resilience. The snap-fit post 48 is preferably perpendicular to, and noncoplaner with the axis of the elongated snap-fit cartridge housing receptacle 58. The first body panel 46 is preferably equipped with a mounting ridge 59. The mounting ridge 59 is for the attachment of internal accessories. The accessories may include weights, electronic devices or mechanical devices such as a music box which is actuated by the removal of the snap-fit cartridge holder 40.

Figure 11:
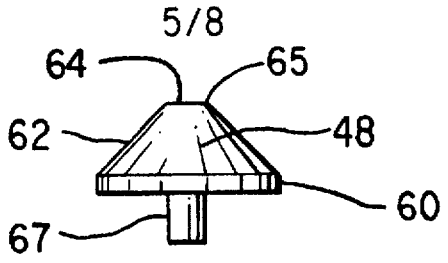
FIG. 11 illustrates an end view of a preferred snap-fit post according to the present invention.

Referring to FIG. 11 a particularly preferred embodiment of a polygonal cross section snap-fit post 48 has straight wall lower base 60, sloping side walls 62, an upper surface 64, radii 65 at the upper edges and a reinforcing web 67. The straight wall lower base 60 improves the resiliency of the post while the radii 65 enhance the removability of the cartridge housing. The use of the terms "lower" and "upper" is relative to the orientation of the post shown in FIG. 11. In actual use, the orientation may be different. The reinforcing web 67 increases the rigidity of the snap-fit post 48 so that the recessed grooves 42 of the snap fit cartridge holder 40 are engaged with greater resilience.

Figure 12:
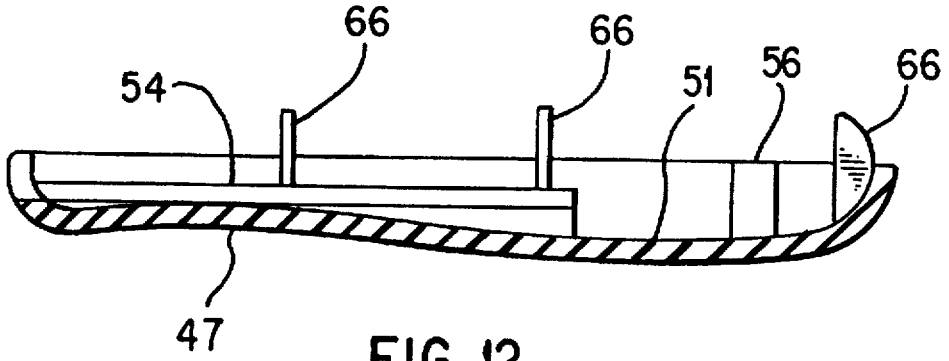
FIG. 12 illustrates a sectional view of the second body panel according to the present invention shown in FIG. 13.

Referring to FIG. 12, the second body panel 47 according to the present invention is preferably equipped with engagement tabs 66 which mate with the inner surface 50 of the first body panel 46. In a preferred embodiment, the shape of the second body panel 47 is convexo-concave and the second body panel 47 is also equipped with at least one longitudinal ridge 54. The second body panel also preferably has one or more abutment tabs 56 which limit the rearward movement of the elongated snap-fit cartridge housing 40.

Figure 13:
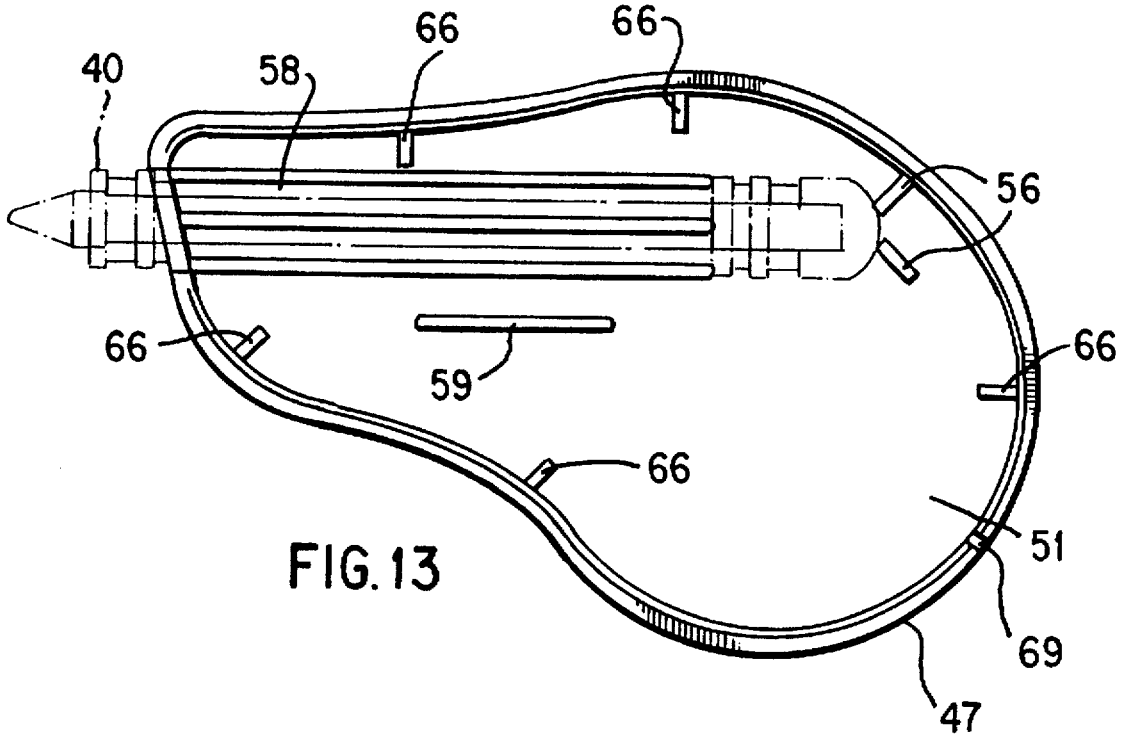
FIG. 13 illustrates a side view of a second body panel together with a cartridge housing according to the present invention.

Referring to FIG. 13, the snap-fit cartridge housing 40 fits within the elongated snap-fit cartridge housing receptacle 58 which is partially defined by the longitudinal ridges 54 and the abutment tabs 56 of the second body panel 47. It can be seen that this particularly preferred body panel has two abutment tabs 56 and five engagement tabs 66. In a preferred embodiment, second body panel 47 is equipped with a recessed slot 69. The recessed slot 69 is for the optional attachment of a spring clip to the hand-held implement. The spring clip (not shown) may be attached to an accessory such as a key chain, a lanyard or an electrical lead. The location of the recessed slot 61 preferably allows the accessory to extend from the hand-held implement and leave the hand through the bottom portion of the hand. Thereby not interfering with the use of the hand-held implement.

Figure 14:
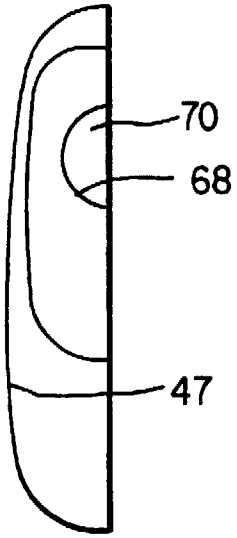
FIG. 14 illustrates an end view of the second body panel shown in FIG. 13.

Referring to FIG. 14, an end view of the second body panel 47 can be seen. The second body panel 47 is equipped with a semicylindrical recess 68 which partially defines a cylindrical snap-fit cartridge housing receptacle orifice 70. However, the snap-fit cartridge housing receptacle orifice can be oval, polygonal or of variable cross section.

Figure 15:
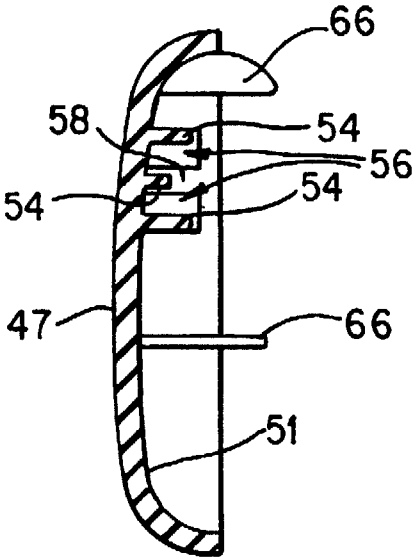
FIG. 15 illustrates a sectional view of the second body panel shown in FIG. 13.

Referring to FIG. 15, the engagement tabs 66 are preferably molded into the inner surface 51 of the second body panel 47. In a preferred embodiment, the inner surface 51 of the second body panel 47 is equipped with three longitudinal ridges 54 and two abutment tabs 56 which partially define the snap-fit cartridge housing receptacle 58.

Figure 16:
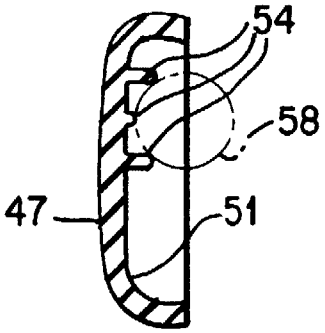
FIG. 16 illustrates a sectional view of the second body panel shown in FIG. 13.

Referring to FIG. 16, a section of the body panel closer to the lower portion 12 than is FIG. 15 is shown. There can be seen the three longitudinal ridges 54 which are preferably molded into the inner surface 51 of the second body panel 47.

Figure 17:
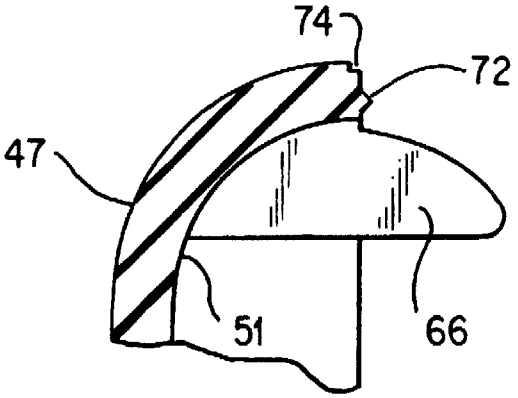
FIG. 17 illustrates a partial sectional view of the second body panel shown in FIG. 13.

Referring to FIG. 17, a partial sectional view is shown. The upper surface of an engagement tab 66 is molded into the inner surface 51 of the second body panel 47 and contacts the inner surface 50 of the first body panel 46 when the two body panels are assembled. The edge of the second body panel 72 preferably includes a multifaced molded edge 74 having a raised ridge which engages the first body panel 46 and promotes a tight seal between the two body panels and structural rigidity of the hand-held implement. In a preferred embodiment, the first body panel and the second body panel are fused together by melting the raised ridge by sonic sealing.

Figure 18:
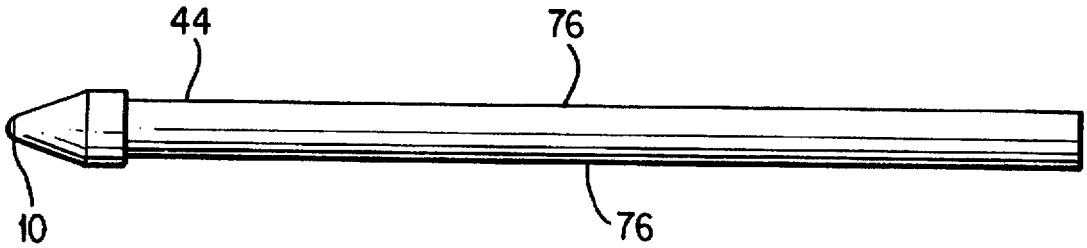
FIG. 18 illustrates a side view of a pen cartridge according to the present invention.

Referring to FIG. 18, a pen cartridge 44 according to the present invention is shown. In a preferred embodiment, the pen cartridge 44 has straight side walls 76 and a conical working tip 10.

Figure 19:
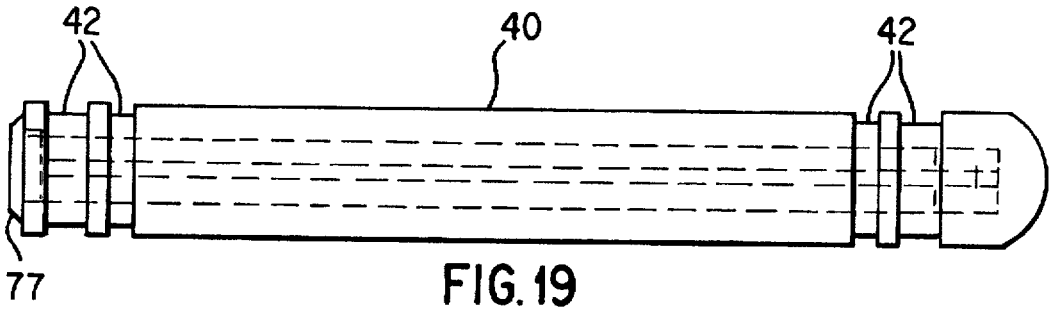
FIG. 19 illustrates a side view of a snap-fit cartridge housing according to the present invention.

Referring to FIG. 19, a snap-fit cartridge housing 40 according to the present invention is shown. The snap-fit cartridge preferably includes two or more coaxial recessed groves 42. In a preferred embodiment, there are four coaxial recessed grooves 42. When at least one recessed groove 42 is provided at each end of the snap-fit cartridge housing, the snap-fit cartridge housing can be readily removed from the assembled body, and then reinserted backwards so that the working tip 10 of the implement is stored within the body. This allows the implement to be stored without the working tip 10 being outwardly exposed. In a particularly preferred embodiment, when the snap-fit cartridge is inserted into the assembled body, the snap-fit post 48 engages only the recess that is closest an end of the snap-fit cartridge housing due to the action of abutment tabs 56. In a preferred embodiment, the snap-fit cartridge housing 40 has a raised beveled edge 77. The raised beveled edge 77 improves the engagement with the snap-fit post 48 and facilitates insertion of the snap-fit cartridge housing 40 into the body of the hand-held implement by aligning the axis of the cartridge housing with the orifice defined by the semicylindrical recess 68.

Figure 20:
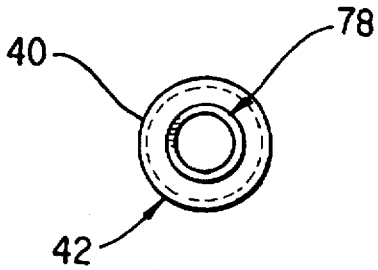
FIG. 20 illustrates an end view of a snap-fit cartridge housing according to the present invention.

Referring to FIG. 20 the snap-fit cartridge housing 40 according to the present invention preferably has a round cartridge receptacle 78. The depth of the coaxial groove 42 can be chosen to optimize the resilient engagement of the snap-fit cartridge housing 40 with the snap-fit post 48.

Figure 21:
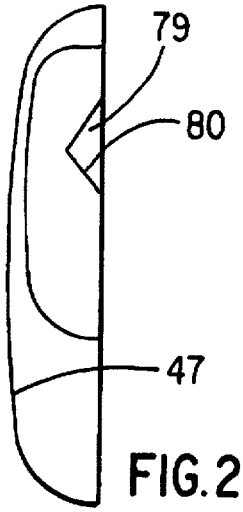
FIG. 21 illustrates an end view of a second body panel according to the present invention.

Referring to FIG. 21, an end view of the second body panel 47 can be seen. The second body panel 47 is equipped with a recess 79 which partially defines a rectilinear snap-fit cartridge housing receptacle orifice 80.

The hand-held implement can be of any suitable dimensions consistent with the above relationships. For example, the distance between the forward and rearward surfaces along the bottom portion can be about one inch (2.5 cm), the width of the forward surface at the bottom portion can be about three eights of an inch (1 cm), and the length of the implement, excluding the tool, can be about two and a quarter inches (5.5 cm). The implement can be scaled up or down so as to provide different implements of different sizes which can thereby accommodate users with different size hands. The implement of the present invention can be made of any material suitable for the intended purpose of the implement. Examples include various polymeric materials, metal, wood and glass. It should also be noted that the side surfaces 16 and 18, in the bulbous upper portion of the device, provide a relatively smooth flat surface which is well-suited for application of art work, logos and advertising.

While there is shown and described herein certain specific structures embodying this invention for the purpose of clarity of understanding, the same is to be considered as illustrative in character, it being understood that only preferred embodiments have been shown and described. It will be manifest to those skilled in the art that certain changes, various modifications and rearrangements of the parts may be made without departing from the spirit and scope of the underlying inventive concept and that the same is not limited to the particular forms herein shown and described except insofar as indicated in the scope of the appended claims.

What is claimed is:

1. A hand-held implement comprising:

a first curved body panel having an inner surface and an outer surface;

an elongated snap-fit post extending from said inner surface of said first panel, having a first end attached to said inner surface of said first curved body panel and having a free second end;

a second curved body panel, having an inner surface and an outer surface, attached to said first body panel so as to define a receptacle for an elongated snap-fit cartridge housing; and an elongated snap-fit cartridge housing having a first coaxial recessed groove, said cartridge housing being removably located within said elongated snap-fit cartridge housing receptacle by said elongated snap-fit post resiliently extending into said first coaxial recessed groove, said cartridge housing being substantially perpendicular to and non-coplanar with said elongated snap-fit post, said elongated snap-fit post extending beside said cartridge housing, wherein said elongated snap-fit post is enclosed within an assembled body of the hand-held implement, said assembled body being defined by said first curved body panel and said second curved body panel.

2. The hand-held implement of claim 1, wherein said elongated snap-fit cartridge housing further comprises a second coaxial recessed groove, into which said snap-fit post is capable of resiliently extending, the first and second coaxial grooves being located so that said second groove is disposed outside said assembled body when said first groove is engaged by the snap-fit post and said first groove is disposed outside said assembled body when said second groove is engaged by the snap-fit post.

3. The hand-held implement of claim 1, wherein said outer surface of said first curved body panel and said outer surface of said second curved body panel define an ergonomic body having:

a bottom portion from which said elongated snap-fit cartridge housing extends;

a forward surface extending upward from the bottom portion, the forward surface being adapted to be engaged by and extend in a direction substantially parallel to the index finger of a user;

first and second opposed side surfaces extending upward from the bottom portion and rearward from the forward surface, the first opposed side surface being adapted to engage the thumb of a user, the second opposed side surface being adapted to engage the side of a third finger of a user;

a rearward surface, the first and second side surfaces extending between said forward surface and said rearward surface; and a first convex contour smoothly joining said forward surface and said rearward surface, said first convex contour being adapted to fit within the palm of a user.

4. The hand-held implement of claim 3, wherein said elongated snap-fit cartridge housing further comprises a second coaxial recessed groove, into which said snap-fit post is capable of resiliently extending, the first and second coaxial grooves being located so that said second groove is disposed outside said assembled body when said first groove is engaged by the snap-fit post and said first groove is disposed outside said assembled body when said second groove is engaged by the snap-fit post.

5. The hand-held implement of claim 3, wherein the rearward surface has a concave contour smoothly joined to the first convex contour.

6. The hand-held implement of claim 5, wherein the side surfaces are provided with opposed concave contours.

7. The hand-held implement of claim 6, wherein the forward surface, the first and second side surfaces and the first convex contour define a bulbous upper portion above the concave contours of the side surfaces.

8. The hand-held implement of claim 6, wherein the forward surface comprises a concave contour and the concave contours of the side surfaces extend between the concave contours of the forward and rearward surfaces.

9. The hand-held implement of claim 6, wherein the implement decreases in width from the forward surface to the rearward surface along the concave contours of the side surfaces.

10. The hand-held implement of claim 6, wherein the concave contours of the side surfaces are adjacent the bottom portion.

11. The hand-held implement of claim 3, wherein the forward surface comprises a first concave contour and a second convex contour extending between the first convex contour and the first concave contour.

12. The hand-held implement of claim 11, wherein the first concave contour is adjacent the bottom portion.

13. The hand-held implement of claim 3, wherein the inner surface of at least one of the first and second panels is provided with a plurality of guide ridges for the cartridge housing, extending from the inner surface.

14. The hand-held implement of claim 1, wherein the snap-fit post comprises a first surface facing said cartridge housing, an opposed second surface which is larger than the first surface, and sloping walls joining the first and second surfaces.

15. The hand-held implement of claim 14, wherein the snap-fit post is provided with a reinforcing web adjacent the second surface.

16. The hand-held implement of claim 14, wherein the snap-fit post is substantially trapezoidal in cross-section.

17. The hand-held implement of claim 1, wherein the inner surface of at least one of the first and second panels is provided with an abutment tab for limiting movement of the cartridge housing in the assembled body.

18. The hand-held implement of claim 1, wherein the cartridge housing is cylindrical.

19. The hand-held implement of claim 1, wherein the receptacle is rectilinear.

20. The hand-held implement of claim 1, wherein the cartridge housing further comprises a pen cartridge.

21. The hand-held implement of claim 1, wherein the cartridge housing further comprises a pencil cartridge.

* * * * *